US008336599B2

(12) United States Patent
Rao

(10) Patent No.: US 8,336,599 B2
(45) Date of Patent: Dec. 25, 2012

(54) SYSTEM AND METHOD FOR ENHANCING CHAPLET FUSION

(75) Inventor: Srinivas Rao, Oshkosh, WI (US); Shankar Rao, legal representative, Chandler, AZ (US)

(73) Assignee: Nuovo Pignone S.p.A., Florence (IT)

( * ) Notice: Subject to any disclaimer, the term of this patent is extended or adjusted under 35 U.S.C. 154(b) by 0 days.

(21) Appl. No.: 13/022,982

(22) Filed: Feb. 8, 2011

(65) Prior Publication Data

US 2011/0209842 A1 Sep. 1, 2011

Related U.S. Application Data

(60) Provisional application No. 61/306,037, filed on Feb. 19, 2010.

(51) Int. Cl.
*B22C 21/14* (2006.01)
*B22D 27/04* (2006.01)

(52) U.S. Cl. ..... 164/30; 164/338.1; 164/398

(58) Field of Classification Search ..... 164/30–32, 164/103–105, 340, 397–399, 338.1, 338.2, 164/122–122.2

See application file for complete search history.

(56) References Cited

U.S. PATENT DOCUMENTS

| | | | | |
|---|---|---|---|---|
| 1,576,317 | A * | 3/1926 | Eklind | 164/105 |
| 2,958,106 | A * | 11/1960 | Fobus | 164/398 |
| 3,596,703 | A | 8/1971 | Bishop et al. | |
| 2010/0044003 | A1 * | 2/2010 | Baumgarten | 164/492 |

FOREIGN PATENT DOCUMENTS

| | | |
|---|---|---|
| GB | 628522 | 8/1949 |
| JP | 63207447 A | 8/1988 |
| JP | 2008055491 A | 3/2008 |

OTHER PUBLICATIONS

International Search Report in corresponding PCT Application No. PCT/US2011/024823 mailed May 16, 2011.

Written Opinion of the International Searching Authority in corresponding PCT Application No. PCT/US2011/024823 mailed May 16, 2011.

* cited by examiner

*Primary Examiner* — Kuang Lin

(74) *Attorney, Agent, or Firm* — Potomac Patent Group PLLC

(57) ABSTRACT

System and method for fusing a chaplet to a casting. The method includes placing the chaplet on an upper surface of a mold; distributing a heater around the chaplet such that the heater is not exposed to the casting; placing a core on the chaplet such that the mold and the core define a component of a machine; heating the chaplet with the heater to a predetermined temperature; and pouring the casting in the mold, around the core and the chaplet, when the chaplet is at the predetermined temperature.

20 Claims, 4 Drawing Sheets

SYSTEM AND METHOD FOR ENHANCING CHAPLET FUSION

CROSS REFERENCE TO RELATED APPLICATIONS

This application is related to, and claims priority of, U.S. Provisional Patent Application Ser. No. 61/306,037 filed on Feb. 19, 2010, entitled "System and Method for Enhancing Chaplet Function".

TECHNICAL FIELD

Embodiments of the subject matter disclosed herein generally relate to methods and systems and, more particularly, to mechanisms and techniques for increasing a fusion between chaplets and a casting material.

DISCUSSION OF THE BACKGROUND

As the oil and gas industry is developing and looking to various ways for generating and producing the energy, the role of the compressors, gas turbines, electrical motors is increasing. For example, in order to transport the natural gas from the production site to the consumers, the natural gas is liquefied for reducing its volume. The process of liquefying the natural gas heavily relies on the use of compressors. Other examples are the transport of $CO_2$, the extraction of the oil and/or gas from the wells, the transport of the carburant through pipes, the processing of the crude oil in the refineries.

Therefore, during the past years, there is an increased interest in producing these machines (compressors, gas turbines, motors, etc.) in a more efficient way. One approach for manufacturing these machines, which have large (from tons to tens or hundredths of tons) casings, stators, rotors and other components, is to cast these components.

Casting is a manufacturing process by which a liquid material is usually poured into a mold, which may contain a core of a desired shape, and then the casting material is allowed to solidify. The solidified part is also known as a casting. The casting is ejected or broken out of the mold to complete the process. Casting materials are usually metals. Casting is most often used for making complex shapes that would be difficult or uneconomical to make by other methods. Such complex shapes may include voids, cavities, tunnels, etc. A compressor, for example, includes these complex shapes.

Thus, in order to achieve such complex shapes, the core is provided inside the mold for determining the voids, cavities, tunnels, etc. However, such cores may be heavy, especially when the machine to be casted is large. Thus, a support element is used to hold the core inside the mold. Such a support element is called a chaplet. The chaplet may be used to support the core from bottom, or to anchor it from the top to prevent the floating of the core when the casting is poured into the mold. A large number of chaplets may be used to prevent the cores from moving during assembly and during pouring.

However, the chaplets may not adhere well to the material that is casted into the mold. Thus, when the formed part, for example, the casing of the machine, is tested for leaks it may fail as leaks could be present between the chaplet, which is now part of the casing, and the neighboring parts of the casing. If this is the situation, the chaplets that do not fuse with the casing have to be drilled out of the casing and plugged or welded at machine shops. This process slows down the manufacturing process of the machine, and adds cost, which is undesirable. After fixing the leaking chaplets, the casing is checked out again for leaks prior to the final assembly of the machine. A hydro test may be performed to determine the leaks.

Accordingly, it would be desirable to provide systems and methods that ensure that the chaplet fully adheres to the casting material so that no leaks exist between the chaplet and the casing.

SUMMARY

According to one exemplary embodiment, there is a method for fusing a chaplet to a casting. The method includes placing the chaplet on an upper surface of a mold; distributing a heater around the chaplet such that the heater is not exposed to the casting; placing a core on the chaplet such that the mold and the core define a component of a machine; heating the chaplet with the heater to a predetermined temperature; and pouring the casting in the mold, around the core and the chaplet, when the chaplet is at the predetermined temperature.

According to another exemplary embodiment, there is a system for casting a component of a machine. The system includes a mold having an upper surface that mirrors an external surface of the component; a core to be placed in the mold and to provide a cavity in the component; at least one chaplet placed on the mold and configured to support the core relative to the mold; and a heater placed next to the chaplet and configured to provide heat to the chaplet.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a dry sand mold. However, the embodiments to be discussed next are not limited to these molds, but may be applied to other molds.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
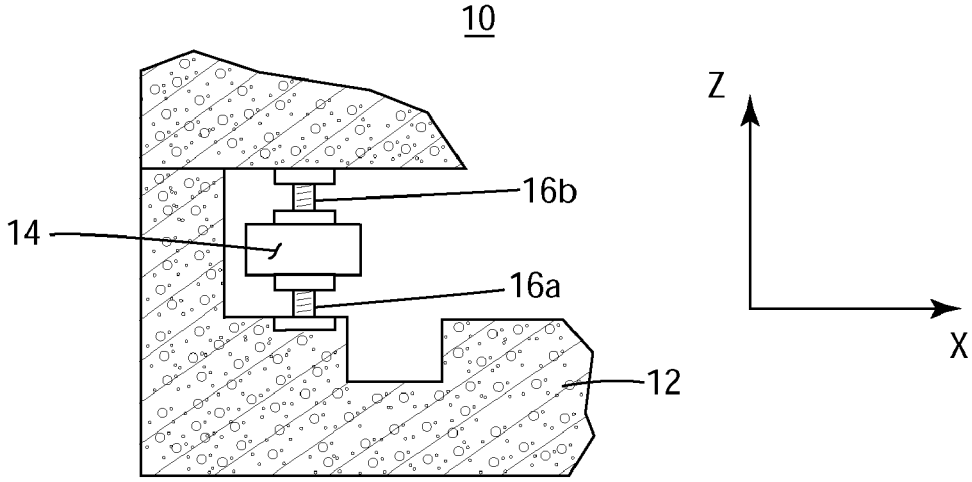
FIG. 1 is a schematic diagram of a mold having a core supported by a chaplet.

For a better understanding of the novel embodiments, an example of a mold having a core supported by a chaplet is shown in FIG. 1. Such a system 10 includes the mold 12 and the core 14. For this example, the core 14 needs to be placed inside the mold 12 to form a cavity in the final product. The core 14 needs to not touch any side of the mold 12. Thus, one or more chaplets 16*a* are provided under the core 14. The chaplets 16*a* are supported by the mold 12. When the casting material is poured around the core 14, the core 14 may move upwards unless one or more chaplets 16*b* are provided above the core 14. With this configuration, the core 14 is fixed along a vertical direction Z relative to the mold 12. However, the core 14 may also move in a horizontal direction X. To prevent this movement, more chaplets (not shown) may be used to fix the core 14 relative to lateral sides of the mold 12.

Figure 2:
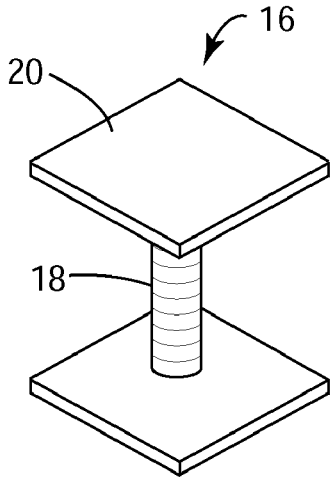
FIG. 2 is a schematic diagram of a chaplet.
Figure 3:
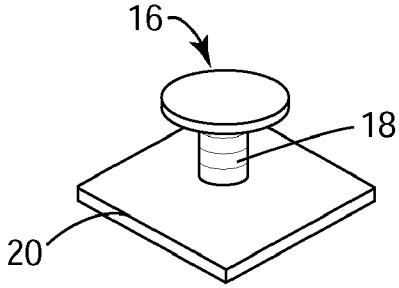
FIG. 3 is a schematic diagram of another chaplet.
Figure 4:
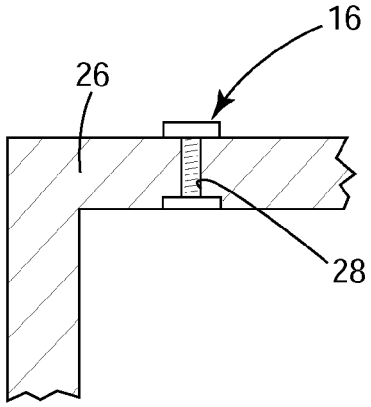
FIG. 4 is a schematic diagram of a chaplet fused to a casting.

A chaplet 16 is shown in more details in FIGS. 2 and 3. The chaplet may have a central region 18 that separates two plate like elements 20 as shown in FIG. 2 or the central region 18 is connected to only one plate like element 20 as shown in FIG. 3. The plate like elements 20 may be arranged to support the core 14. After the casting has been performed, the casting is removed from the mold 12 and core 14. A part of such a casting 26 is shown in FIG. 4. It is noted that chaplet 16 is now part of the casting 26 and the chaplet 16 will stay in the casting 26 for the life of the machine in which the casing is installed.

However, if an interface 28 between the casting 26 and the chaplet 16 includes cracks or pockets, a leak may appear when a fluid is provided inside the casting. In this case, the chaplet 16 has to be removed from the casting 26 and a plug should be installed to seal a hole left by the removal of the chaplet 16. This action is undesirable.

Cracks or pockets between the casting 26 and chaplet 16 may appear due to various known and unknown conditions. Considerable effort has been spent by the manufacturers of casting pieces to prevent these phenomena from occurring. The problem is further complicated as the chaplets are made from a material that can support the weight of the core and also does not melt when the casting (melted metal or other compound) is poured into the mold while the casting includes different materials. In other words, the materials that have to fuse (the material of the chaplet and the material of the casting) are different, having different physical properties, and having different crystalline structures that may not match each other. For example, the chaplet may be made of steel while the casting may be iron based.

The inventor has discovered that the fusing between these different materials may be enhanced if the chaplet is heated to a predetermined temperature when the casting is poured into the mold. In an exemplary embodiment, if the casting material is poured at around 1000° F., the chaplet is heated prior to pouring at about 150 to 300° F. In one application, the chaplet is heated to about 200 to 250° F. It was observed that by having the temperatures of the chaplet and casting material closer to each other but not very close, the fusing process is better and less cracks and pockets appear at the interface between the chaplet and the casting.

Figure 5:
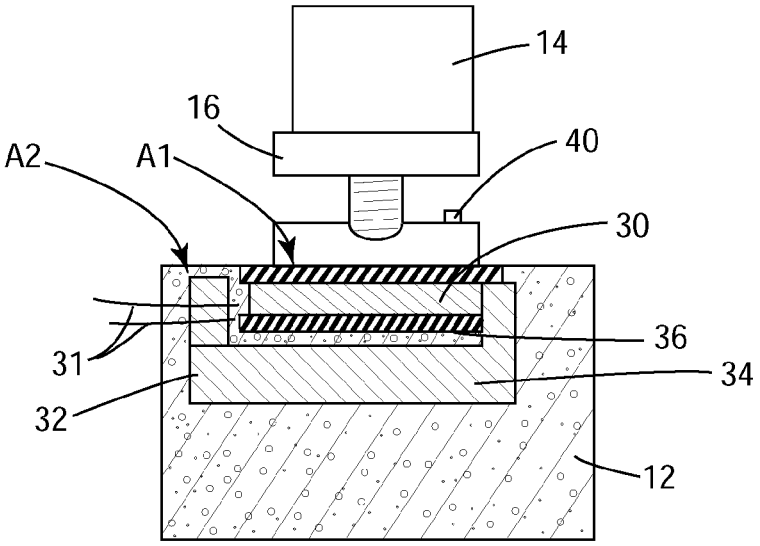
FIG. 5 is a schematic diagram of a chaplet provided with a heater and supported by a supporting layer according to an exemplary embodiment.

According to an exemplary embodiment shown in FIG. 5, to heat the chaplet to the desired temperature, a heater 30 may be provided close to an end of the chaplet 16. Heater 30 may have leads 31 that connect the heater to a power source (not shown). FIG. 5 shows that a cavity (depression) 32 is formed in the mold 12 to accommodate a portion of the chaplet 16. More specifically, a layer 34 of a material having a low thermal conductivity may be provided on the walls of the cavity 32, to prevent heat from heater 30 entering the mold 12. Layer 34 may include Kaowool Paper (produced by Thermal-Ceramics, Georgia, USA) which is a flexible material having heat storage properties and a low thermal conductivity.

A support chaplet layer 36 may be provided in the cavity 32, over the layer 34. The support chaplet layer 36 is configured to distribute a weight of the chaplet 16 and the core 14 over a larger area of the mold 12 as the mold 12 may be made of dry sand, which is known to not have a high strength. The support chaplet layer 36 may include graphite. Also, the support chaplet layer 36 has good thermal conductivity as it is desired that heat from heater 30 is quickly and efficiently transmitted to chaplet 16. According to an exemplary embodiment, the support chaplet layer 36 has a largest area larger than a largest area of the chaplet 16 such that the weight of the chaplet 16 is distributed to a larger area of the mold 12. Support chaplet layer 36 and layer 34 may be optional.

Figure 6:
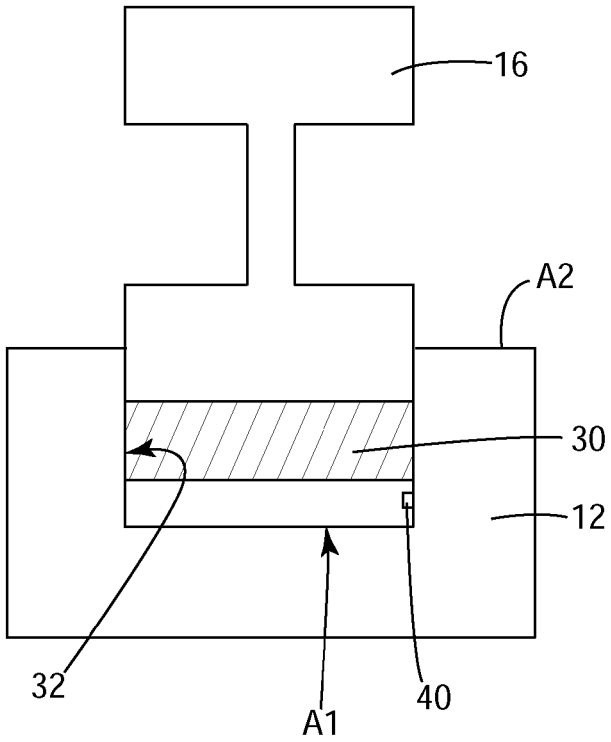
FIG. 6 is a schematic diagram of a chaplet provided with a heater according to an exemplary embodiment.

Heater 30 may be provided around the support chaplet layer 36, underneath it or both around and underneath the support chaplet layer 36. In this arrangement, the heater 30 is not in direct contact with the chaplet 16. However, according to another exemplary embodiment, the heater 30 may be provided in direct contact with chaplet 16. Chaplet 16 is provided over the support chaplet layer 36 as shown in FIG. 5. A bottom side surface A1 of the chaplet 16 may be provided flush with a top surface A2 of the mold 12. However, in one application, the bottom side surface A1 of the chaplet 16 may be provided inside cavity 32 as shown in FIG. 6. FIG. 6 also shows the chaplet 16 provided inside cavity 32 with no support chaplet layer 36. According to this exemplary embodiment, the heater 30 is wrapped around the chaplet 16. Alternatively, the heater 30 may be wrapped around the support chaplet layer 36 when present.

Figure 7:
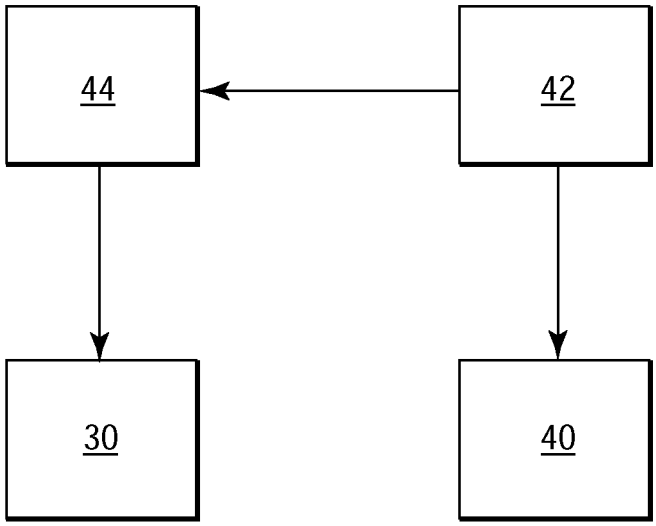
FIG. 7 is a schematic diagram of a control logic that controls a heater according to an exemplary embodiment.

For determining a temperature of the chaplet 16, one or more sensors 40 may be provided at different locations, for example, in the cavity (depression) 32, in contact with the support chaplet layer 36, in contact with the chaplet 16, etc. Further, in one application, a control logic element 42 may be connected to the sensor 40 and to a power source 44 of the heater 30, as shown in FIG. 7, for coordinating a heating of the chaplet 16. The control logic element may be a microprocessor. The microprocessor may be programmed to heat the chaplet 16 until a desired temperature is reached. The desired temperature may be inputted by a user. The control logic element 42 may be a computer having the known input/output capabilities.

Figure 8:
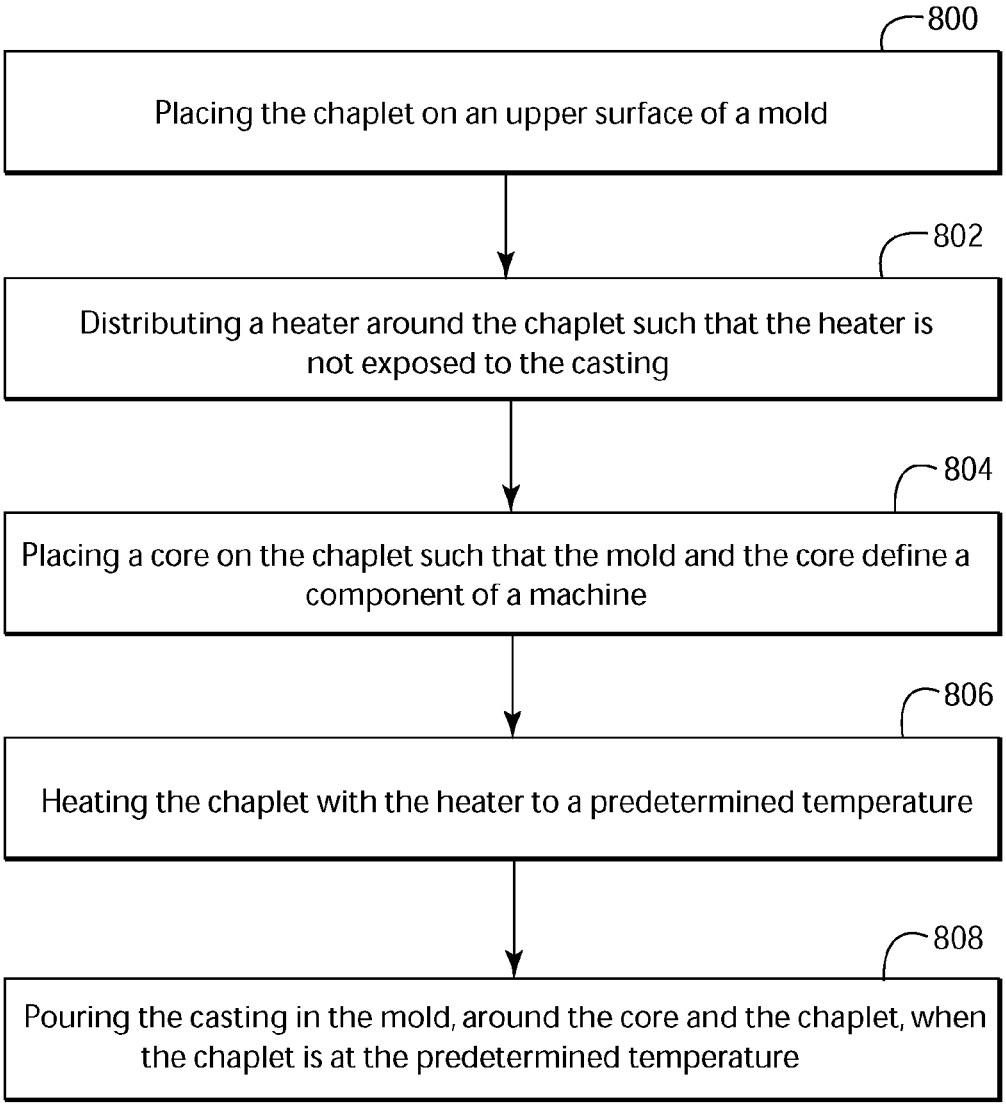
FIG. 8 is a flow chart of a method for fusing a chaplet to a casing casting according to an exemplary embodiment.

According to an exemplary embodiment illustrated in FIG. 8, there is a method for fusing a chaplet to a casting. The method includes a step 800 of placing the chaplet on an upper surface of a mold, a step 802 of distributing a heater around the chaplet such that the heater is not exposed to the casting, a step 804 of placing a core on the chaplet such that the mold and the core define a component of a machine, a step 806 of heating the chaplet with the heater to a predetermined temperature, and a step 808 of pouring the casting in the mold, around the core and the chaplet, when the chaplet is at the predetermined temperature.

The disclosed exemplary embodiments provide a system and a method for increasing a likelihood that a chaplet fusions with a casting during a casting process. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A method for fusing a chaplet to a casting, the method comprising:

placing the chaplet on an upper surface of a mold;

distributing a heater within the mold and around the chaplet such that the heater is not exposed to the casting;

placing a core on the chaplet such that the mold and the core define a component of a machine;

heating the chaplet with the heater to a predetermined temperature; and pouring the casting in the mold, around the core and the chaplet, when the chaplet is at the predetermined temperature.

2. The method of claim 1, further comprising:

forming a depression in the upper surface of the mold to accommodate the chaplet; and placing the chaplet in the depression such that a lowest surface of the chaplet is not flush with the upper surface of the mold.

3. The method of claim 2, further comprising:

placing a support chaplet layer between the depression and the chaplet such that a largest area of the support chaplet layer is larger than a largest area of the chaplet for distributing a weight of the chaplet and the core over the upper surface of the mold.

4. The method of claim 3, further comprising:

wrapping the heater around the support chaplet layer such that the heater is entirely distributed inside the depression, below the upper surface of the mold.

5. The method of claim 4, further comprising:

insulating the depression from the heater, the support chaplet layer and the chaplet with a low thermal conductivity layer to prevent heat from the heater diffusing into the mold.

6. The method of claim 1, further comprising:

wrapping the heater around side surfaces of the chaplet, wherein the heater is an electric heater.

7. The method of claim 1, further comprising:

switching off the heater after pouring the casting.

8. The method of claim 1, wherein the predetermined temperature is around 250° F.

9. The method of claim 1, wherein the chaplet is made of steel and the casting is iron based.

10. The method of claim 1, further comprising:

removing from the mold the casting fused with the chaplet after both materials are cooled; and applying a hydro test to check whether an interface between the chaplet and the casting is leaking.

11. The method of claim 1, further comprising:

using plural chaplets to support the core, each chaplet being heated with a corresponding heater.

12. A system for casting a component of a machine, the system comprising:

a mold having an upper surface that mirrors an external surface of the component;

a core to be placed in the mold and to provide a cavity in the component;

at least one chaplet placed on the mold and configured to support the core relative to the mold; and a heater placed within the mold and around the chaplet such that the heater is not exposed to the casting, and configured to provide heat to the chaplet.

13. The system of claim 12, wherein the mold and the core include sand.

14. The system of claim 12, wherein the mold is configured to have a depression in which a part of the chaplet is provided.

15. The system of claim 14, further comprising:

a support chaplet layer provided between a bottom of the depression and the chaplet.

16. The system of claim 15, wherein the heater is wrapped around the support chaplet layer.

17. The system of claim 15, wherein the heater is wrapped around the chaplet.

18. The system of claim 15, further comprising:

a low thermal conductivity material configured to insulate the depression from the chaplet and the heater to prevent heat flowing to the mold.

19. The system of claim 15, further comprising:

one or more temperature sensors configured to measure a temperature of the chaplet; and a control logic circuit configured to control the heater for heating the chaplet at a predetermined temperature.

20. The system of claim 15, wherein the chaplet is made of steel, the casting is iron based, the chaplet support layer includes graphite, the core and the mold include sand, and the machine is a compressor.

* * * * *